US005141172A

United States Patent [19]

Holcomb

[11] Patent Number: 5,141,172

[45] Date of Patent: Aug. 25, 1992

[54] LEVEL WIND SPOOLING DEVICE WITH REDUCED WEAR, FRICTION AND OIL CONTAMINATION

[76] Inventor: Jimmy F. Holcomb, Rt. 1, Box 37B, Liemoris, W. Va. 25125

[21] Appl. No.: 792,220

[22] Filed: Nov. 6, 1991

[51] Int. Cl.[5] ..... B65H 54/28

[52] U.S. Cl. ..... 242/158.3; 74/57

[58] Field of Search ..... 242/158.3, 158.5, 158 R, 242/158.4 R, 158.4 A; 74/56, 57, 58, 569

[56] References Cited

U.S. PATENT DOCUMENTS

| | | | |
|---|---|---|---|
| 2,457,829 | 1/1949 | Miller | 74/57 X |
| 2,714,998 | 8/1955 | Guilbert. Jr. | 242/158.3 |
| 3,784,126 | 1/1974 | Petry | 242/158.3 |
| 3,998,404 | 12/1976 | Reese | 242/158.3 |
| 5,033,692 | 7/1991 | Holcomb | 242/158.3 |

*Primary Examiner*—Stanley N. Gilreath
*Attorney, Agent, or Firm*—Jim Zegeer

[57] ABSTRACT

A level wind spooling device has a housing with lateral end walls, top, bottom, front and back walls forming a lubrication chamber. A spooling shaft journaled in the end walls is adapted to be connected to a rotary drive and has a cam track formed on the surface thereof and a cam track follower is engageable with the cam track and operatively moves the cam track follower back and forth along a linear path. An arm secured to the follower and passing through a slot in the housing and a flexible strand guide is secured to the arm means. Metal-to-metal sliding action is eliminated and thus reducing wear, oil contamination from metal particles and heat generation and is more efficient. The spooling shaft is lower in the oil housing to allow the spooling shaft to be more completely immersed in oil for better lubication of all internal components. The carriage follower assembly utilizes two roller bearing sets on the lower surface of the follower assembly guided by two steel guide bars on the bottom wall. There are no sliding metal-to-metal surfaces and all internal and external forces which tend to distort or damage the spooling shaft are eliminated. This arrangement results in a thinner level winding device having greater life and a higher efficiency.

2 Claims, 2 Drawing Sheets

LEVEL WIND SPOOLING DEVICE WITH REDUCED WEAR, FRICTION AND OIL CONTAMINATION

This invention is an improvement over the invention disclosed in my U.S. Pat. No. 5,033,692.

1. Field of the Invention

This invention relates to a more efficient level wind spooling device with reduced wear, friction and oil contamination and better lubrication of the spooling shaft and carriage follower.

2. Background and Brief Description of the Invention

In my U.S. Pat. No. 5,033,692, the spooling shaft is located close to the bottom of the oil pan housing and the carriage follower is guided by front and rear pairs of guide bars which are spaced to receive caged roller bearings mounted on the front and rear of the carriage follower. The bearing rollers eliminate sliding metal to metal contact. This arrangement reduces the wear, friction and oil contamination present in devices such as disclosed in U.S. Pat. No. 3,784,126 to Petry, permits the spooling shaft to be lowered to allow it to be better immersed in oil for better lubrication. Moreover, the carriage follower assembly, which in the preferred embodiment utilizes four roller bearings, two on each side and the four steel guide bars, two on each side, so that all internal and external forces tending distort or damage the spooling shaft are reduced or eliminated. My prior invention features an oil pan housing utilizing two guide bars on each side, and a cam follower assembly utilizing two caged roller bearings, each caged roller bearing assembly having two spaced apart caged roller bearings bolted to each side to let the cam follower assembly move freely without friction and without excess wear. Each of the bearings roll between the upper and lower guide bars which are made of hardened steel. The two top guide bars are bolted in place to allow for easy assembly and disassembly and the two bottom bars are permanently affixed in place as by welding. By this means, the carriage follower assembly is completely stabilized and, as noted above, virtually all outside and inside forces which could be applied to the spooling shaft are minimized or eliminated.

The improved level wind spooling device has reduced friction, wear and tear, and oil contamination and is easily disassembled for cleaning and/or repair, is more efficient and has a much longer life than prior art level wind spooling assemblies.

There are some installations which require a thin oil pan housing. In such installation there is insufficient space for pairs of roller bearings on both sides of the spooling shaft and cam track follower. According to this invention this is solved by providing a pair of spaced roller bearing assemblies on the bottom side of the cam track follower and a pair of spaced guide rails on the bottom wall of the oil pan housing for constraining the pair of spaced roller bearing assemblies.

BRIEF DESCRIPTION OF THE DRAWINGS

The above and other objects, advantages and features of the invention will become more apparent when considered with the following specification and accompanying drawings wherein.

DETAILED DESCRIPTION OF THE PRIOR INVENTION

Figure 1:
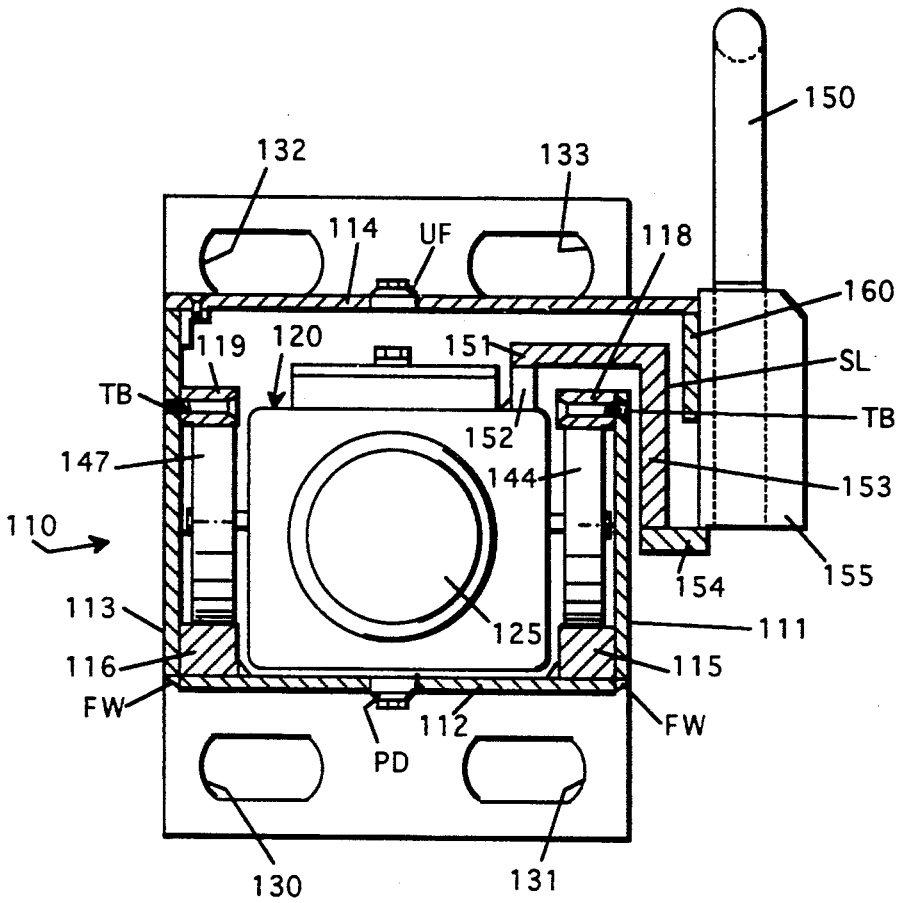
FIG. 1 is an end view in elevation and in section, illustrating in detail the features of my U.S. Pat. No. 5,033,692.
Figure 2:
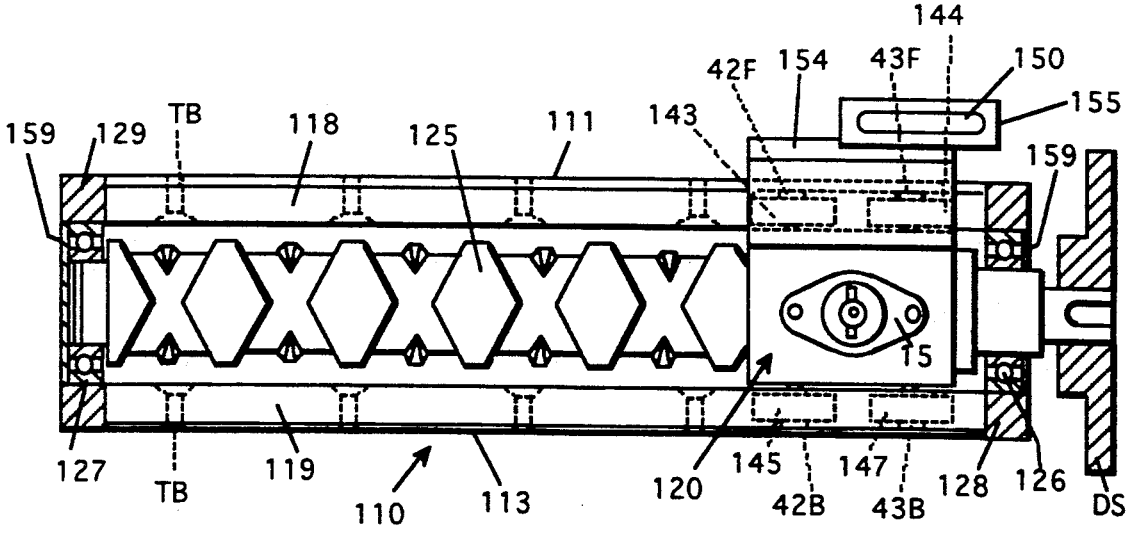
FIG. 2 is a top plan view of the level wind spooling device of FIG. 1.

Referring to FIGS. 1 and 1, oil pan housing 110 is provided with front wall 111, bottom wall 112, back wall 113 welded by filet welds FW. Rectangular, hardened key steel guides or rails 115, 116 are welded in the inside lower corners to provide bracing for the sidewalls and bottom and, at the same time, provide a guide for caged roller bearings to be described more fully hereafter. Near the top inside of front wall 111 and back wall 113 are bolted two additional hardened steel guides or rails 118 and 119, respectively, which are bolted in place after installation of the carriage follower assembly 120. This arrangement thus permits the cam follower assembly and the spooling shaft 125 to be positioned so as to be better immersed in the oil pool maintained in the housing 110 for better lubrication of the spooling shaft 125, follower 120 and roller bearings and guide rails. The oil can be added through a upper fill UF and drained through plugged drain PD in bottom wall 112. Spooling shaft 125 is journaled by bearings 126, 127 in end plates or walls 128, 129 which are welded to the lateral ends of front wall 111, bottom wall 112 and back wall 113. Top wall 114 is secured by brackets and bolts to the tops of back wall 113. The end plate or wall 129 has elongated mounting bolt holes 130, 131, 132, 133, there being four such bolt holes in each end plate to allow for adjustment. Carriage follower assembly 120 has a pair of laterally projecting stub axles 42F, 43F on the front side and two 42B, 43B on the back side upon which are mounted caged roller bearings 143, 144, 145, and 147, respectively. The top bars 118 and 119 are bolted in place by bolts TB. A very small clearance of 1/16" to 1/32" is provided at the top of the rollers is adequate. Depending on the direction of rotation of the spooling shaft 125, the carriage follower assembly and its laterally extending caged roller bearings 143, 144, 145 and 147 will bear either on the lower right guide bar 115 and upper left guide bar 119, or lower left guide bar 116 and upper right guide bar 118 and roll freely as the carriage follower assembly is moved by the right and left-handed threads on the spooling cam shaft (see FIG. 2).

An actuator 15 can be engaged or disengaged to engage the cam follower carriage with the right-left-handed threaded shaft. The vertical strand guide assembly 150 is secured by arms 151, 152, 153, 154 and 155 to carriage follower assembly 120 and extend through the slot SL formed between the depending short wall 160. The spooling shaft itself is coupled to a drive sprocket DS shown on the right end of the shaft in FIG. 2. Snap rings 159 are utilized to seal the bearing journals for the cam shaft in the end plates or walls 128, 129.

Thus, my prior eliminates the metal-to-metal sliding action and thus reduces wear, oil contamination and heat generation and is more efficient. Moreover, in FIGS. 1 and 2, the spooling shaft is lowered in the oil housing to allow the spooling shaft to be more completely immersed in oil for better lubrication of all internal components. The carriage follower assembly utilizes four roller bearings, two on each side, and four steel guide bars, two on each side so that all internal and external forces which tend to distort or damage the spooling shaft are eliminated. Metal particles from the sliding of metal-on-metal are eliminated thus avoiding lubricant contamination and possible damage to the spooling shaft and carriage follower by loose metal particles. This arrangement results in a level winding device having greater life and a higher efficiency in that it reduces the loading on the drive device.

THE PRESENT INVENTION

Figure 3:
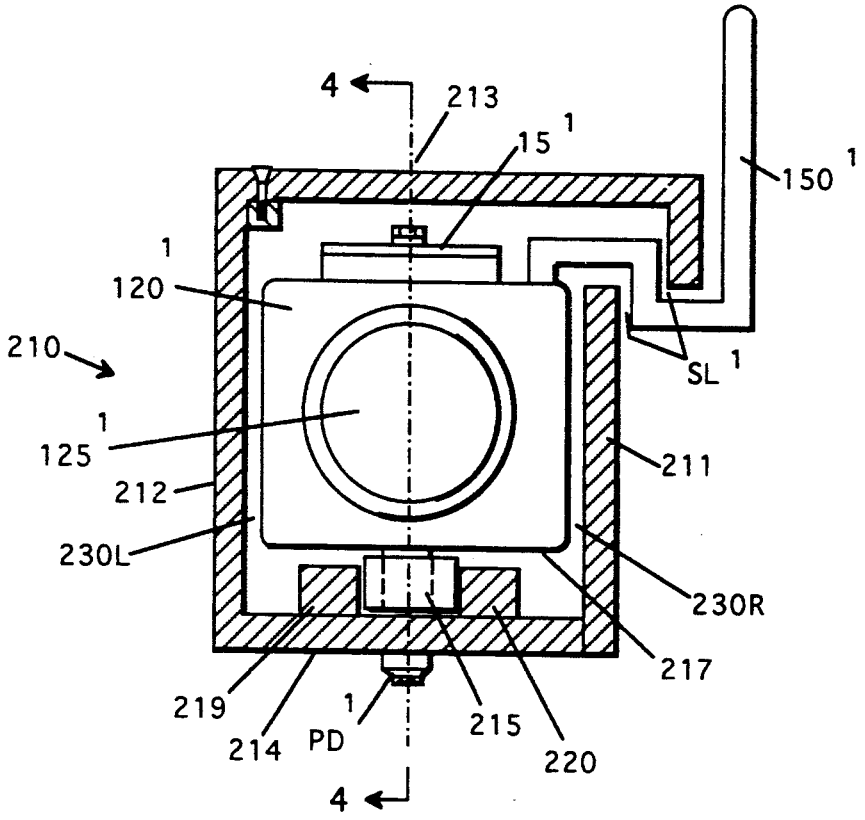
FIG. 3 is an end view of a level wind spooling device incorporating the present invention.
Figure 4:
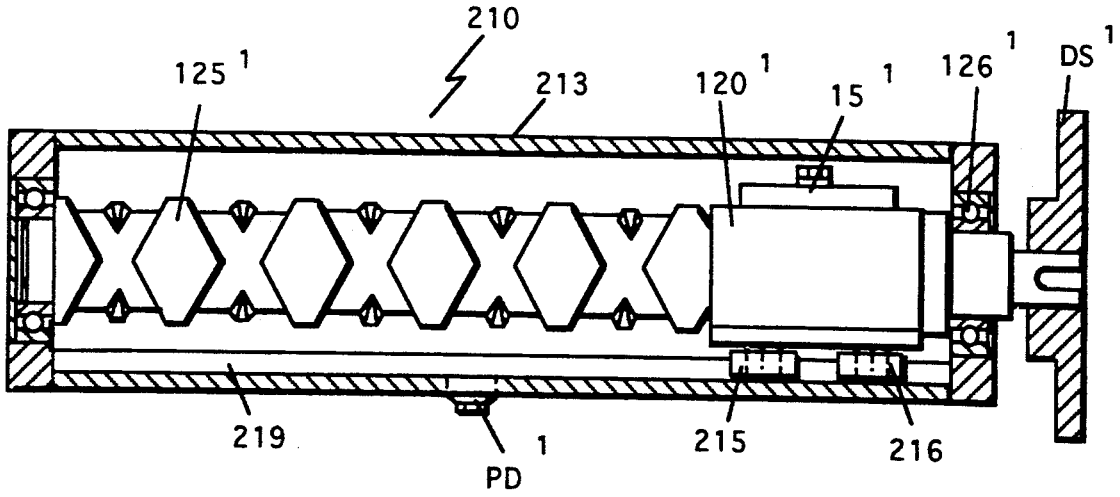
FIG. 4 is a side view thereof.

Referring to FIGS. 3 and 4, oil pan housing 210 has front 211 and back 212 walls, bottom wall 214 and a removable top wall 213 forming slot SL'. Vertical strand guide assembly 150, is coupled through slot SL' in the same way to carriage follower assembly 120'. According to the present invention, a single pair of sealed roller bearings 215 and 216 are journaled on the lower surface of assembly 120'. A single pair of bearing guide rails 219 and 220 are secured (by bolts or welding) to bottom wall 214. By positioning a pair of roller bearings on the bottom surface 217 of carriage follower assembly 120', the front and back walls 211 and 212 can be placed closer to the carriage follower assembly 120'. While the spooling shaft 125' is raised slightly higher into the oil pan housing, this arrangement assures that bearings 215 and 216 are always immersed in oil with the bearing guide rails 219 and 220.

The clearances 230L and 230R between the sidewalls 212 and 211, respectively, is such that there is never any metal-to-metal contact between the follower 120' and the walls 212 and 211, and that lubricant can easily flow therebetween.

The level spool unit of the present invention is thereby made substantially thinner than the one disclosed in my U.S. Pat. No. 5,033,692 while at the same time, completely stabilizing the carriage follower, eliminating sliding metal-to-metal friction contacts. A more efficient unit having a longer life is achieved thereby.

While I have disclosed a preferred embodiment of my invention, it will be clear that variations of details of construction which are specifically illustrated and described may be resorted to without departing from the true spirit and scope of the invention as defined in the appended claims.

What is claimed is:

1. In a level wind spooling device, a housing having lateral end walls, elongated top, bottom, front and back walls forming a lubricant chamber, bearing means in said lateral end walls and a spooling shaft journaled in said bearing means and having a drive end projecting through one of said end walls and adapted to be connected to a rotary drive, cam track means formed on the surface of said spooling shaft, a cam track follower on said spooling shaft and in engagement with said cam track means for operatively moving said follower back and forth along a linear path, means forming an elongated slot in one of said elongated walls, arm means secured to said follower and passing through said slot and a flexible strand guide secured to said arm means, the improvement comprising a pair of spaced roller bearing means secured on the bottom of said cam track follower, and spaced linear rail means secured to said bottom wall and to each side of said roller bearing means for constraining said roller bearing means and said cam track follower to move along said linear path and preclude any sliding and rubbing contact between said follower and any portion of said housing.

2. In a level wind spooling device having a housing with lateral end walls, top elongated, bottom, front and back walls forming a lubrication chamber, spooling shaft bearing means in said lateral end walls, respectively, a spooling shaft journaled in said spooling shaft bearing means and having a drive end projecting through one of said lateral end walls and adapted to be connected to a rotary drive, cam track means formed on the surface of said spooling shaft and a cam track follower mounted on said spooling shaft and in engagement with said cam track means for operatively moving the cam track follower back and forth along a linear path and means forming an elongated slot in one of said elongated walls and arm means secured to the follower and passing through said slot and a flexible strand guide secured to said arm means, the improvement comprising said cam track follower having a bottom surface, roller bearings mounted on said bottom surface, a pair of linear guide rail means engaged solely by said roller bearing means secured to said bottom wall to define a straight linear path for said roller bearing means.

* * * * *